US009447658B2

(12) United States Patent
He et al.

(10) Patent No.: US 9,447,658 B2
(45) Date of Patent: Sep. 20, 2016

(54) CHEMICAL INJECTION MANDREL PRESSURE SHUT OFF DEVICE

(71) Applicants: Zhi Yong He, Cypress, TX (US); Jorge Arreola, Houston, TX (US)

(72) Inventors: Zhi Yong He, Cypress, TX (US); Jorge Arreola, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 359 days.

(21) Appl. No.: 14/091,750

(22) Filed: Nov. 27, 2013

(65) Prior Publication Data

US 2015/0144352 A1 May 28, 2015

(51) Int. Cl.
*E21B 37/06* (2006.01)

(52) U.S. Cl.
CPC ..... *E21B 37/06* (2013.01)

(58) Field of Classification Search
CPC ..... E21B 34/14; E21B 34/08; E21B 34/10; E21B 43/123
See application file for complete search history.

(56) References Cited

U.S. PATENT DOCUMENTS 2,493,650 A * 1/1950 Baker ..... E21B 34/14 137/71
2,994,335 A * 8/1961 Dudley ..... E21B 43/123 137/155
3,092,131 A * 6/1963 Lamb ..... E21B 43/123 137/155
3,105,509 A * 10/1963 Moore, Jr. ..... E21B 43/123 137/102
3,183,922 A * 5/1965 Lamb ..... E21B 43/123 137/155
3,225,783 A * 12/1965 Stacha ..... E21B 43/123 137/155
3,306,313 A * 2/1967 Roach ..... E21B 43/123 137/102
3,626,969 A * 12/1971 Garrett ..... E21B 23/02 137/115.13
3,722,527 A * 3/1973 Blackwell ..... E21B 43/123 137/155
4,059,157 A * 11/1977 Crowe ..... E21B 34/063 137/68.22
4,562,854 A 1/1986 Pringle
5,141,056 A 8/1992 Tailby
5,971,004 A * 10/1999 Pringle ..... E21B 34/066 137/155
6,070,608 A * 6/2000 Pringle ..... E21B 34/066 137/155

(Continued)

FOREIGN PATENT DOCUMENTS

EP 2636842 A1 9/2013
WO WO 2012136966 A2 * 10/2012 ..... E21B 34/08

OTHER PUBLICATIONS

International Search Report for International Application No. PCT/US2014/066831 International Filing Date Nov. 21, 2014; Report mail date Feb. 27, 2015 (4 pages).

(Continued)

*Primary Examiner* — Jennifer H Gay
(74) *Attorney, Agent, or Firm* — Cantor Colburn LLP

(57) ABSTRACT

A shut off system for a hydrocarbon recovery mandrel includes an inline valve assembly that contains a nipple that includes a chemical flow line. The chemical flow line is operative to transfer fluids from outside the wellbore to a mandrel channel; where the mandrel channel is disposed in the mandrel. A valve assembly includes a cylinder and a piston shaft; where the cylinder contacts the chemical flow line; where the piston shaft reciprocates in the cylinder in response to opposing applied pressures. The piston shaft contacts a sealing object that is operative to facilitate or to prevent fluid flow from the chemical flow line to the mandrel channel. The cylinder includes a port that provides fluid communication from the cylinder to the mandrel channel and an actuating assembly; where the actuating assembly is operative to displace the piston shaft in the cylinder to prevent fluid communication between the chemical flow line and the mandrel channel.

18 Claims, 8 Drawing Sheets

(56) References Cited

U.S. PATENT DOCUMENTS

| | | | | |
|---|---|---|---|---|
| 6,536,524 | B1 * | 3/2003 | Snider | E21B 23/00 166/297 |
| 6,663,361 | B2 | 12/2003 | Kohl | |
| 6,889,707 | B2 | 5/2005 | Nicolino | |
| 7,234,524 | B2 | 6/2007 | Shaw | |
| 7,716,979 | B1 * | 5/2010 | Abshire | E21B 47/1025 166/250.01 |
| 9,062,518 | B2 * | 6/2015 | Patel | E21B 34/10 |
| 2002/0079104 | A1 * | 6/2002 | Garcia | E21B 34/06 166/373 |
| 2007/0277878 | A1 | 12/2007 | Strattan | |
| 2009/0008102 | A1 * | 1/2009 | Anderson | E21B 34/10 166/373 |
| 2009/0205831 | A1 * | 8/2009 | Jacob | E21B 34/105 166/311 |
| 2011/0108279 | A1 * | 5/2011 | June | E21B 33/038 166/321 |
| 2011/0192480 | A1 * | 8/2011 | Willauer | E21B 34/06 137/637 |
| 2012/0305256 | A1 * | 12/2012 | Tveiten | E21B 43/123 166/319 |
| 2013/0048303 | A1 | 2/2013 | Patel | |
| 2013/0180592 | A1 | 7/2013 | He | |
| 2013/0220599 | A1 * | 8/2013 | Rae | G01M 3/02 166/250.01 |
| 2014/0182855 | A1 * | 7/2014 | Woodford | E21B 34/08 166/305.1 |
| 2014/0367115 | A1 * | 12/2014 | He | E21B 43/12 166/373 |
| 2015/0008003 | A1 * | 1/2015 | Lafleur | E21B 47/01 166/386 |
| 2015/0144352 | A1 * | 5/2015 | He | E21B 37/06 166/373 |
| 2015/0275624 | A1 * | 10/2015 | Coles | E21B 33/1294 166/373 |

OTHER PUBLICATIONS

Written Opinion for International Application No. PCT/US2014/066831 International Filing Date Nov. 21, 2014; Report mail date Feb. 27, 2015 (8 pages).

* cited by examiner 10
1'
12
1
(top view)

10
14
21
22
20A
18A
16A
14
Fluid flow
24
15
24
Section along 1-1'

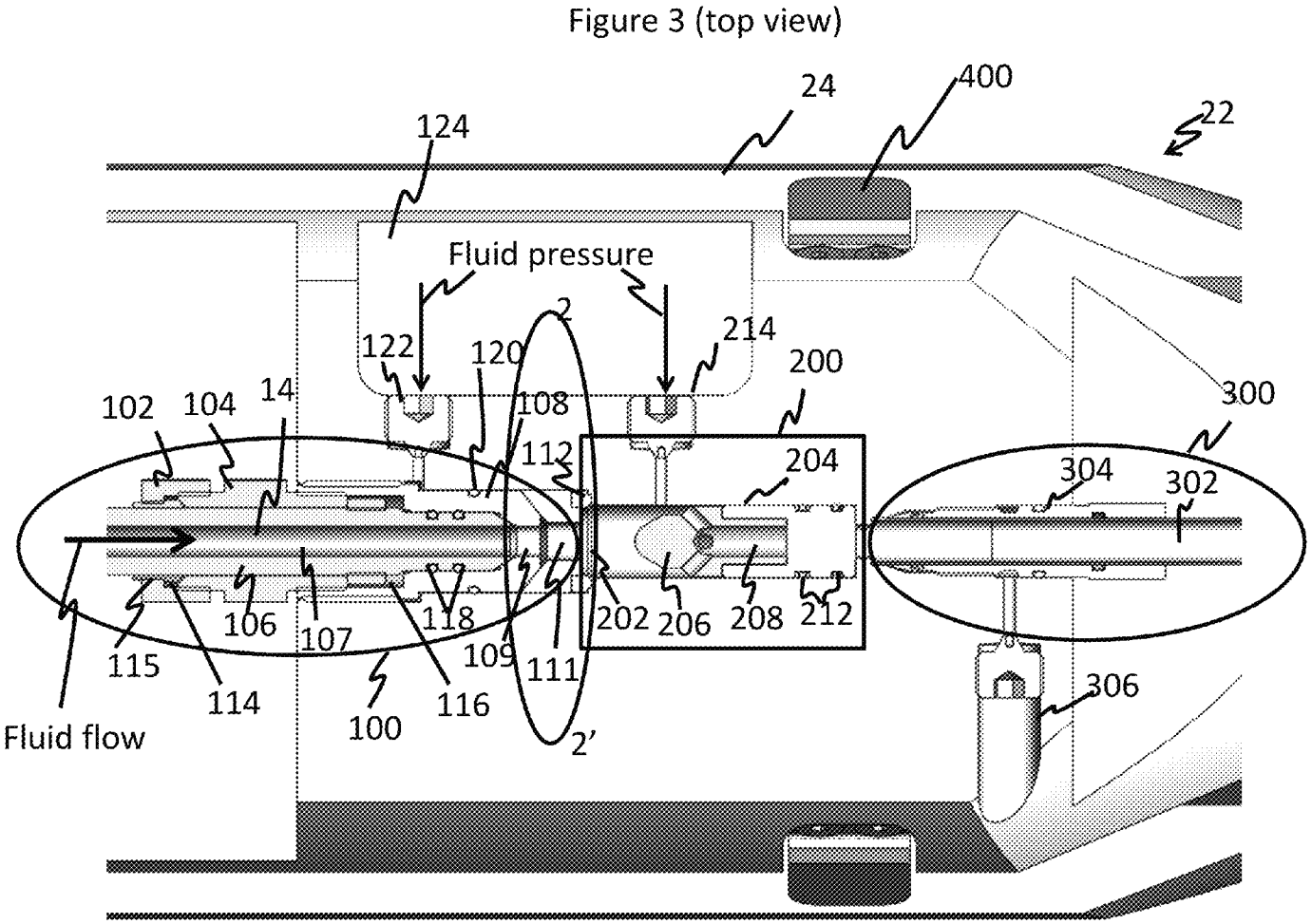
Figure 3 (top view)

Expanded view of section 2-2'

CHEMICAL INJECTION MANDREL PRESSURE SHUT OFF DEVICE

BACKGROUND

This disclosure is related to a chemical injection shut off device. In particular, this disclosure is related to a chemical injection pressure shut off device that is affixed to a mandrel.

Injection is a process of sending water, steam and/or other chemicals into a well bore to stimulate production. Debris clogs flow lines. During chemical injection operations, for example, various completion chemicals are flowed into a wellbore. Many such chemicals incorporate dissolved limestone or other powdered solids which are carried by a liquid. These chemicals have a tendency to clump and clog the flow line. It is therefore desirable to determine a method for removing the debris in the mandrel flow line (also referred to herein as a mandrel channel).

SUMMARY

Disclosed herein is a shut off system for a hydrocarbon recovery mandrel comprising an inline valve assembly comprising a nipple comprising a chemical flow line; the chemical flow line being operative to transfer fluids from outside the wellbore to a mandrel channel; where the mandrel channel is disposed in the mandrel; a valve assembly comprising a cylinder and a piston shaft; where the cylinder contacts the chemical flow line; where the piston shaft reciprocates in the cylinder in response to opposing applied pressures; where the piston shaft contacts a sealing object that is operative to facilitate or to prevent fluid flow from the chemical flow line to the mandrel channel; where the cylinder comprises a port that provides fluid communication from the cylinder to the mandrel channel; and an actuating assembly; where the actuating assembly is operative to displace the piston shaft in the cylinder to prevent fluid communication between the chemical flow line and the mandrel channel.

Disclosed herein is a method comprising discharging a chemical fluid from outside a wellbore to a mandrel channel through a chemical flow line in a shut off system; where the shut off system comprises an inline valve assembly comprising a nipple comprising a chemical flow line; the chemical flow line being operative to transfer fluids from outside the wellbore to a mandrel channel; where the mandrel channel is disposed in the mandrel; a valve assembly comprising a cylinder and a piston shaft; where the cylinder contacts the chemical flow line; where the piston shaft reciprocates in the cylinder in response to opposing applied pressures; where the piston shaft contacts a sealing object that is operative to facilitate or to prevent fluid flow from the chemical flow line to the mandrel channel; where the cylinder comprises a port that provides fluid communication from the cylinder to the mandrel channel; and an actuating assembly; where the actuating assembly is operative to displace the piston shaft in the cylinder; increasing the pressure of the fluid in the chemical flow line to exceed the pressure exerted by the actuating system on the piston shaft; displacing the sealing object from the chemical flow line; and facilitating the flow of fluid from the chemical flow line to the mandrel channel.

BRIEF DESCRIPTION OF THE FIGURES

FIG. 3 depicts a top view one exemplary embodiment of the shut off device;

DETAILED DESCRIPTION

Disclosed herein is a chemical injection shut off device for reducing debris from within a flowpath such as the flowline into a wellbore. This results in the debris being less likely to clog the flowline, thus permitting the easy flow along through the flowline to the wellbore. In an embodiment, a self-cleaning downhole debris reducer is incorporated into a flowline to a chemical injector that is used to inject chemicals into a wellbore. The chemical injector has a shut off system that permits injection of chemicals into the flowline when desired.

Figure 1:
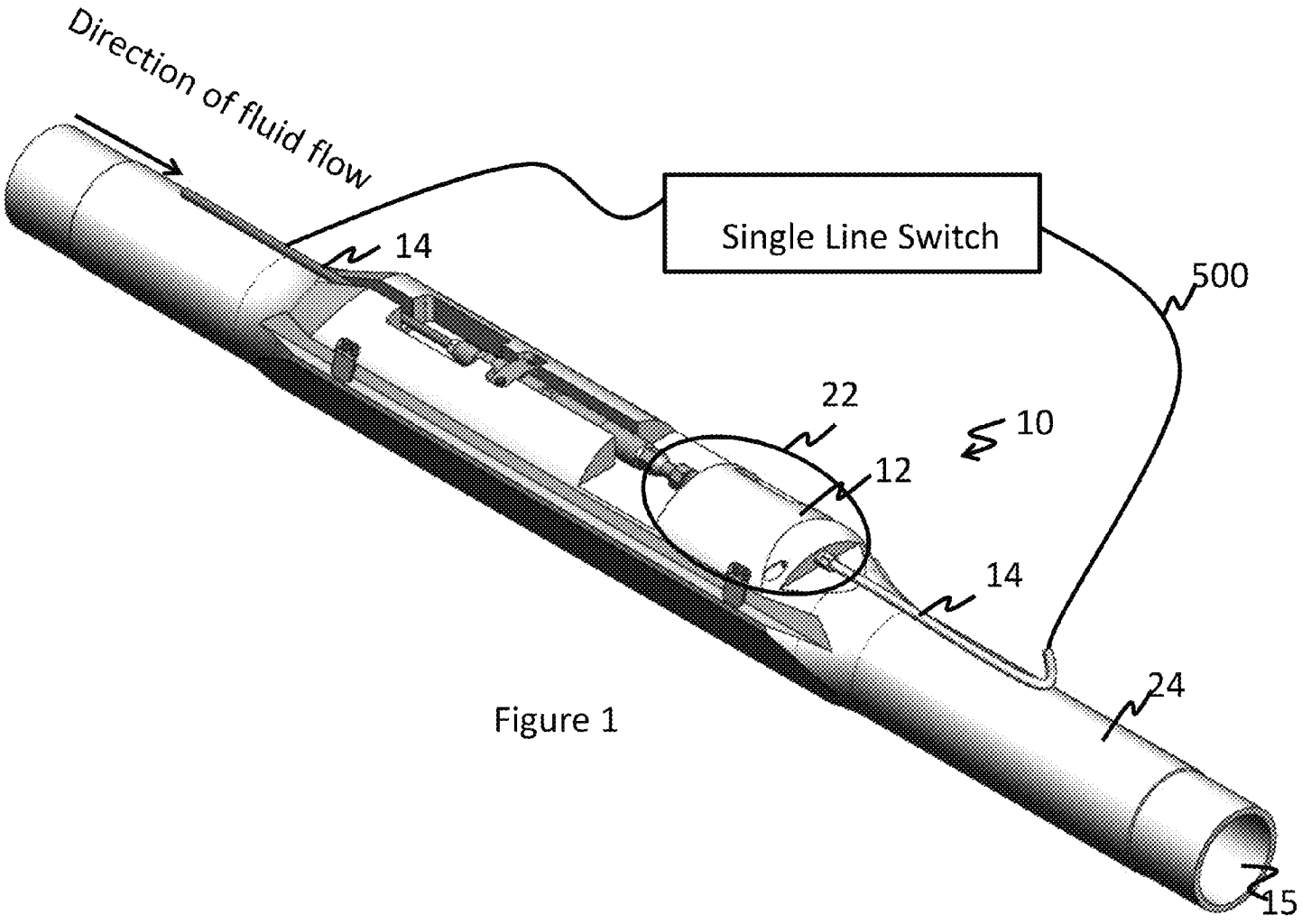
FIG. 1 depicts an exemplary embodiment of the chemical injection shut off device.
Figures 2A, 2B:
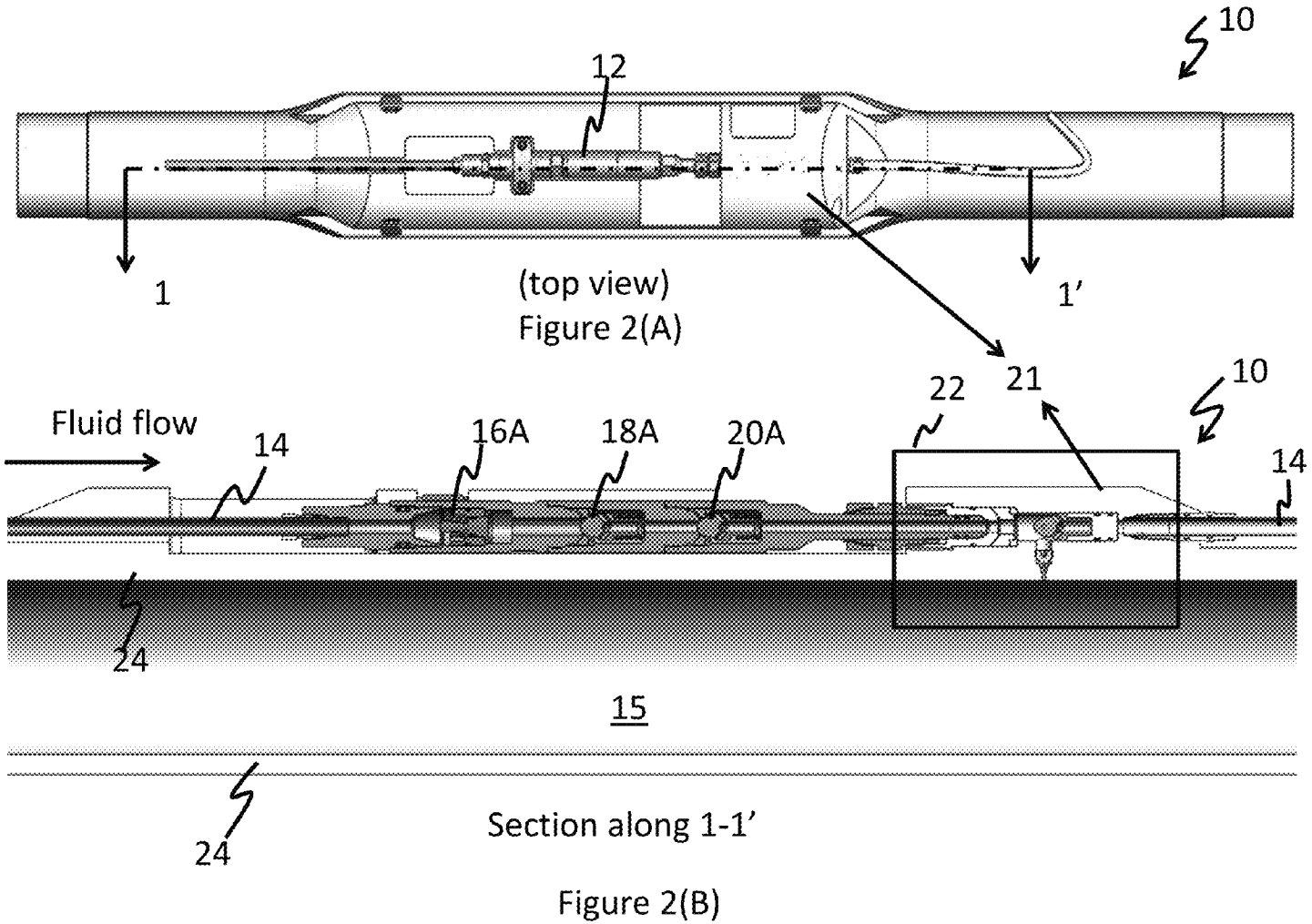
FIG. 2(A) shows a top view of the chemical injection device.
FIG. 2(B) is an expanded view of the section 1-1' from the FIG. 2(A)

FIGS. 1, 2(A) and 2(B) are exemplary embodiments of a chemical injection shut off system 10 (hereinafter shutoff system 10) that comprises a shut off device 22. The chemical injection shut off system 10 includes an in-line chemical injector 12 of a type known in the art. Details related to chemical injection and chemical injectors are described in, for example, U.S. Pat. No. 6,663,361 entitled "Subsea Chemical Injection Pump" and issued to Kohl et al. and U.S. Pat. No. 7,234,524 entitled "Subsea Chemical Injection Unit for Additive Injection and Monitoring System for Oilfield Operations" issued to Shaw et al. Both of these patents are owned by the assignee of the present invention and which are herein incorporated by reference. Chemical flowline 14 extends from the surface of a wellbore (not shown) wherein it is typically operably associated with a supply of chemical to be injected and a fluid pump (not shown), as is known in the art.

FIG. 1 is an isometric view of an assembled shut off system 10 that depicts the in-line chemical injector 12 that is in fluid communication with a mandrel 24 that contains a mandrel flow line 15 (also called a mandrel channel 15). A shut off device 22 is positioned along the shut off system 10. The shut off device 22 may have a protective covering 21 disposed over it and functions to permit chemical flow into the mandrel 24 to remove debris from the mandrel during operation. The protective covering is an extended portion of the mandrel 24 body, which forms a pocket into which the shut off device 22 may be disposed. The mandrel 24 extends from the surface of a wellbore (not shown) wherein it is typically operably associated with a supply of chemical to be injected and a fluid pump (not shown), as is known in the art. FIG. 2(A) shows a top view of the chemical injection valve 10, while the FIG. 2(B) is an expanded view of the section 1-1' from the FIG. 2(A). The section 1-1' is a section taken perpendicular to the plane of the paper and reflects a side view of the shut off system. In the FIG. 1, an optional switch line 500 contacts an actuating assembly 300 and the chemical flow line 14 and provides a mechanism for reversing the direction of travel of a piston shaft in the shut off valve. This is detailed later.

In the FIG. 2(A), the chemical injector 12 is disposed on an outer circumference of a mandrel 24. The chemical injector 12 comprises a piston shear-off device 16A that is in mechanical communication with a plurality of check valves 18A, 20A and the shut off device 22. The piston shear-off device 16A and the check valves 18A, 20A will not be described in greater detail here. The first check valve 18A and a second check valve 20A prevent any back flow in the chemical flow line 14. As can be seen in the FIG. 2(A), a chemical fluid stream that is injected into chemical flow line 14 will travel through the piston shear-off device 16A, the first check valve 18A, the second check valve 20A and the shut off device 22 to the mandrel flow line 15 (the mandrel flow line is also referred to as the mandrel channel 15).

FIG. 3 depicts a top view one exemplary embodiment of the shut off device 22. The shut off device a valve assembly 200 that is disposed between an inline valve assembly 100 and an actuating assembly 300. The valve assembly 200 lies downstream of the inline valve assembly 100. The inline valve assembly 100, the valve assembly 200 and the actuating assembly 300 are disposed on an outer circumference of the mandrel 24. The entire shut off system 10 has a retainer 400 (see FIG. 3) that holds the control line in place.

The inline valve assembly 100 facilitates locating the chemical flow line 14 such that it contacts the valve assembly 200 and lies concentric to the valve assembly 200. The inline valve assembly 100 comprises a nut 102 that secures the inline valve assembly 100 in position with the valve assembly 200. In addition to the nut 102, the inline valve assembly comprises a collet 104 that surrounds a nipple 106, a sleeve 108 that mates with the nipple 106, and a check pad 110 that mates with the sleeve 108. The chemical flow line 14 is disposed in the collet 104 that is located in a nipple 106. A split collet 115 is disposed between the nut 102 and the collet 104 and facilitates the securing of the collet 104 on the nipple 106. The nut 102 when thus tightened secures the collet 104 to the nipple 106, which is in turn secured to the sleeve 108, with the sleeve 108 being secured to the check pad 110.

The collet 104 and the nipple 106 serve to position the chemical flow line 14 in a sleeve 108 that contacts a check pad 110. The sleeve 108, the check pad 110 and the nipple 106 serve to position the chemical flow line 14 to be concentric with a hydraulic fluid line 302 that is contained in the actuating assembly 300. The check pad 110 contacts a compression ring 112 that is disposed around the periphery of a valve seat 202 in a manner to prevent fluid loss between the inline valve assembly 100 and the valve assembly 200. The nut 102 is threaded and can be screwed onto the collet 104 via a first insert 114. A second insert 116 is disposed between the collet 104 and the sleeve 108. The first insert 114 and the second insert 116 may be manufactured from an elastomer or from a soft metal and serves to minimize leakage from the inline valve assembly 100.

The nipple 106 has a channel 107 disposed through it that acts as the chemical flow line 14. The channel 107 has a circular cross-sectional area, but other geometries can also be used. In order to better illustrate to the reader a better view of the mating between the nipple 106 and the sleeve 108 and between the sleeve 108 and the check pad 110 a section 2-2' from the FIG. 3 is depicted in the FIG. 4.

Figure 4:
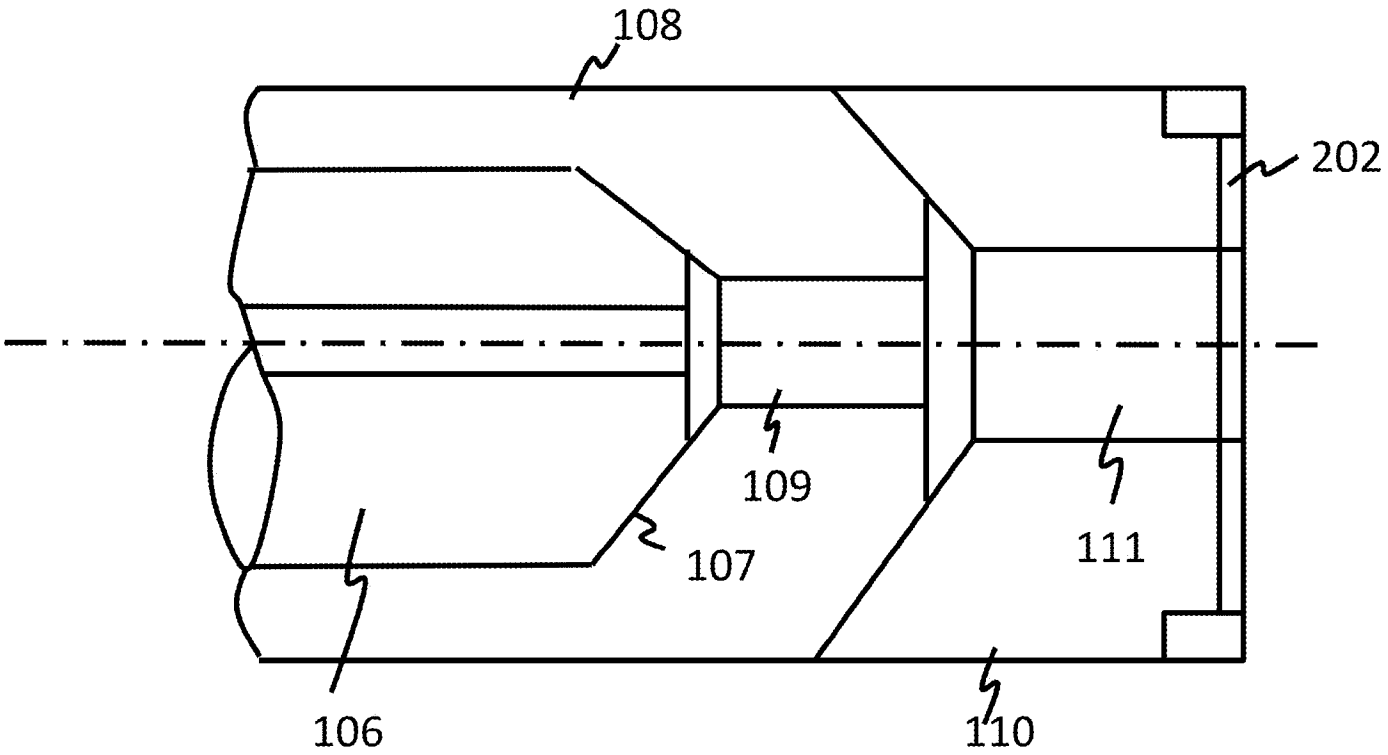
FIG. 4 depicts an expanded view of the section encircled 2-2' from the FIG. 3.

As can be clearly seen in the FIG. 4, the sleeve 108 has a section that includes a tapered portion 107 (e.g., a beveled surface) that culminates in a first receiving cup 109. The lower end of the nipple 106 also has a tapered surface that mates with the tapered portion 107 of the sleeve 108. The respective tapered portions of the nipple 106 and the sleeve 108 are opposedly disposed (i.e., have a male and female mating surface respectively) and mate with each other when brought into contact with each other. The tapered surface of the sleeve 108 functions to guide the nipple 106 thereby aligning the chemical flow line 14 with the shut off valve 22. A plurality of seals 118 disposed between the nipple 106 and the sleeve 108 form a fluid tight (e.g., leak proof) contact so that fluid in the chemical flow line can flow from outside the wellbore to a desired location in the wellbore without any leakage. It is desirable to completely reduce or to minimize leakage from the chemical flow line 14 to the outside and the seals 118 facilitate preventing or minimizing any such leakage.

In other words, the tapered portion 107 of the sleeve 108 and the seals 118 are operative to facilitate receipt of the nipple 106 in the sleeve 108 and serve as guides to align the chemical flow line with the valve assembly 200 via the first receiving cup 109. The contact surfaces between the nipple 106 and the sleeve 108 should preferably prevent leakage of any fluid from the chemical flow line 14 during operation or during testing (when the system is tested to up to 2900 pounds per square inch). The seals 118 (in addition to facilitate locating the chemical flow line 14 within the shut off valve 22) can also function as seals and acts to prevent leakage at the surface contact between the nipple 106 and the sleeve 108. In a similar manner, the contact point between the chemical flow line 14 and the first receiving cup 109 should prevent any fluid leakage from the chemical flow line.

As detailed above, the sleeve 108 contacts a check pad 110. The sleeve surface and the check pad surface are both tapered and are opposedly disposed mating surfaces (i.e., male and female mating surfaces) that form a leak proof contact. As can be seen in the FIG. 3, the check pad 110 contacts a second receiving cup 111 that is operative to contact the first receiving cup 109 to form another fluid tight (e.g., leak proof) contact point. The check pad 110 contacts the compression ring 112 that is disposed on the periphery of the valve seat 202. The valve seat 202 is part of the valve assembly 200. The contact between the check pad 110 and the compression ring 112 is operative to prevent fluid loss between the inline valve assembly 100 and the valve assembly 200. The compression ring 112 can be manufactured from a soft metal or from an elastomer.

As can be seen in the FIG. 3, a variety of optional seals may be used to prevent fluid loss from the inline valve assembly 100. For example, a first insert 114 may be disposed between the nut 102 and the first block 104, while a second insert 116 is disposed between the collet 104 and the sleeve 108. Seals 118 may be used to locate and lock the nipple 106 in a desired position in the sleeve 108. An O-ring seal 120 may be disposed between the inline valve assembly 100 and the mandrel 24. These seals may be manufactured from an elastomer or from a soft metal.

An optional test plug 122 is disposed on an outer surface of the sleeve 106. The test plug 122 functions to test the inline valve assembly 100 for leaks. A pressurized fluid can be injected from chamber 124 into the test plug 122 as shown by the direction of the arrow in the FIG. 3 to check for leaks in the inline valve assembly 100. The test plug 122 is optional and can be excluded from the system if desired.

Figure 5:
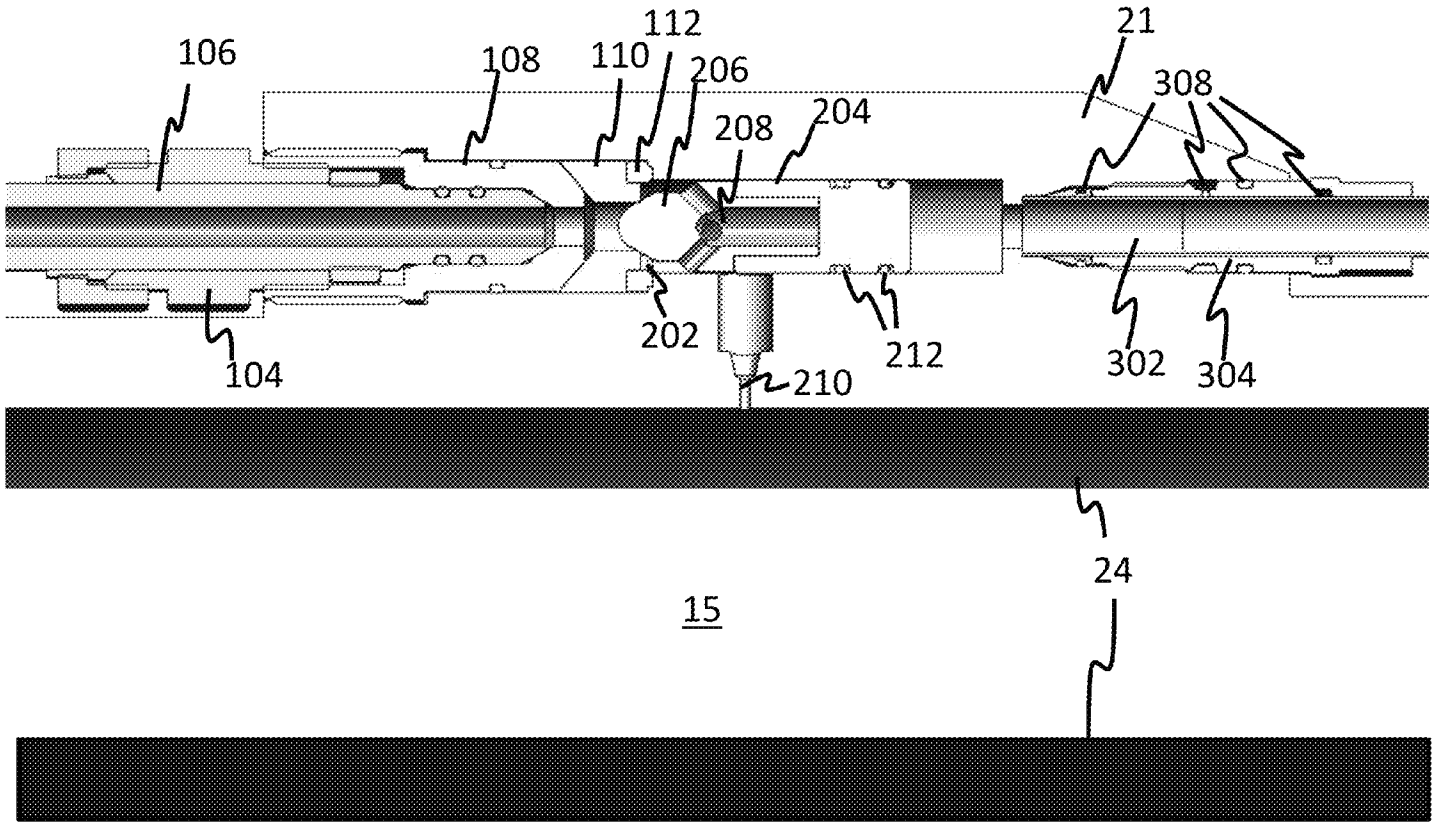
FIG. 5 is a side view of the shut off system and depicts the communication between the valve assembly and the mandrel channel via port.

The valve assembly 200 comprises a cylinder 204 in which is disposed a piston shaft 208. The cylinder 204 has a port 210 as shown in the FIG. 5, which enables fluid communication between the chemical flow line 14 and the mandrel channel 15 (See FIG. 1). The FIG. 5 is a side view of the shut off system 10 and depicts the communication between the valve assembly 200 and the mandrel channel 15 via port 210.

The piston shaft 208 has disposed on it a sealing object 206 and can move back and forth to prevent the flow of fluid from the chemical flow line 14 to the mandrel channel 15. The piston shaft 208 and the sealing object 206 when activated via the actuating assembly 300, contacts the valve seat 202 to shut off the fluid flow from the chemical flow line 14 to the mandrel channel 15. When it is desired to allow for fluid to flow into the mandrel channel 15, the pressure in the chemical flow line 14 is increased to be greater than the pressure generated by the actuating assembly 300. This increase in pressure displaces the sealing object 206 away from the valve seat 202 thus permitting fluid from the chemical flow line to enter the mandrel channel 15 via the port 210 as shown in the FIG. 5.

The sealing object 206 can be a ball, a sluice, a gate, a check dart, or the like and contacts the valve seat 202 to prevent the flow of fluid from the inline valve assembly 100 into the valve assembly 200. The cylinder 204 contains optional O-ring seals 212 disposed on its outer surface to contact the mandrel 24 to prevent leakage from the cylinder 204 to the mandrel 24. An optional test plug 214 is disposed on an outer surface of the sleeve 106 to test the valve assembly for leakage. The functioning of the test plug 214 has already been detailed above and will not be discussed again.

Once again with reference to the FIGS. 3 and 5, the valve assembly 200 contacts the actuating assembly 300. The actuating assembly 300 comprises an actuator 302 disposed in a sleeve 304 that drives the piston shaft 208 to contact the valve seat 202 to shut off the flow of fluid from the chemical flow line 14 to the mandrel channel 15. The actuating assembly 300 can comprise a hydraulic actuator, an electrical actuator, a pneumatic actuator. The actuating assembly 300 is capable of pressurizing the piston shaft 208 to a pressure greater than that in the chemical flow line, thus displacing the piston shaft 208 till the sealing object 206 contacts the valve seat 202 to cut off the flow of fluid from the chemical flow line 14 to the mandrel channel 15.

The sleeve 304 has disposed upon it a plurality of O-ring seals 308 that prevent fluid leakage from the actuating assembly 300. In addition, the actuating assembly 300 also contacts a test plug 308 (see FIG. 3) to check for leaks. The test plugs seen in the FIG. 3 are optional and one or more can be excluded from the design without any detriment to the shut off system 10.

In one embodiment, in one method of using the shut off system 22, a chemical fluid at a pressure (that is higher than the pressure imposed by the actuation system 300) acts on the piston shaft 208 to displace it from the valve seat 202. An open passage is created from the chemical flow line 14 to the mandrel channel 15 (see FIGS. 3 and 5) thus permitting the flow of chemicals to dissolve or to degrade any debris collected in the mandrel channel 15. When the mandrel channel 15 is substantially cleared of the debris, the actuation system 300 is actuated to increase the pressure on the piston shaft 208 so that the sealing object 206 is moved to contact the valve seat 202. The contacting of the valve seat 202 by the sealing object 206 prevents any further fluid flow from the chemical flow line 14 to the mandrel channel 15.

In an embodiment, the switch line 500 (see FIG. 1) is use to reverse the direction of travel of the piston shaft 208 in order to close the shut off valve and terminate fluid communication between the chemical flow line 14 and the mandrel channel 15. In other words, when it is desired to discharge chemicals into the mandrel channel 16, the chemicals under pressure are directed along the chemical flow line to contact the sealing object 206. The sealing object 206 is displaced from the valve seat 202 and the chemicals flow through the valve cylinder 204 into the mandrel channel 15. When it is desired to terminate the flow into the mandrel channel 15, the valves 18A and 20A are shut off thus directing the pressurized chemicals into the switch line 500, which causes the sealing object 206 to contact the valve seat 202. When the sealing object 206 contacts the valve seat 202, the fluid flow into the mandrel channel 15 is terminated.

Figure 6:
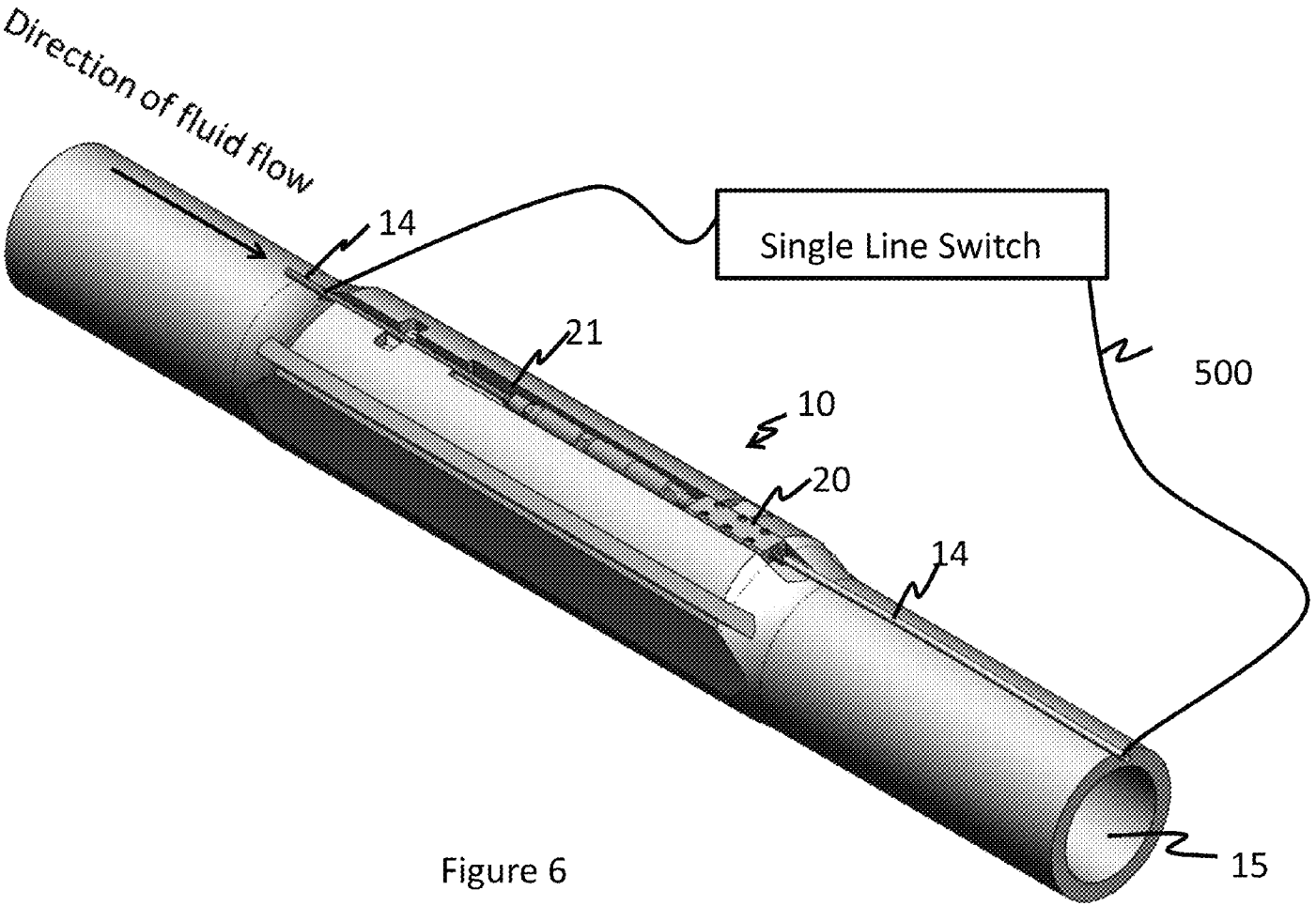
FIG. 6 is an isometric view of the shut off system comprising a shut off device disposed in a manifold that is bolted to the mandrel.

In another exemplary embodiment depicted the shut off system 10 may be designed in a manifold version as shown in the FIG. 6. In the manifold version, the there is no protective cover as seen in the FIG. 1, but rather the shut off system 10 in the form of a manifold is disposed in a slot in the mandrel 24. FIG. 6 is an isometric view of the shut off system 10 comprising a shut off device (not shown) disposed in a manifold 20 and placed in a slot 21 in the mandrel 24. All of the other reference numerals in the FIG. 6 have the same meaning as discussed and detailed in the FIG. 1.

Figure 7:
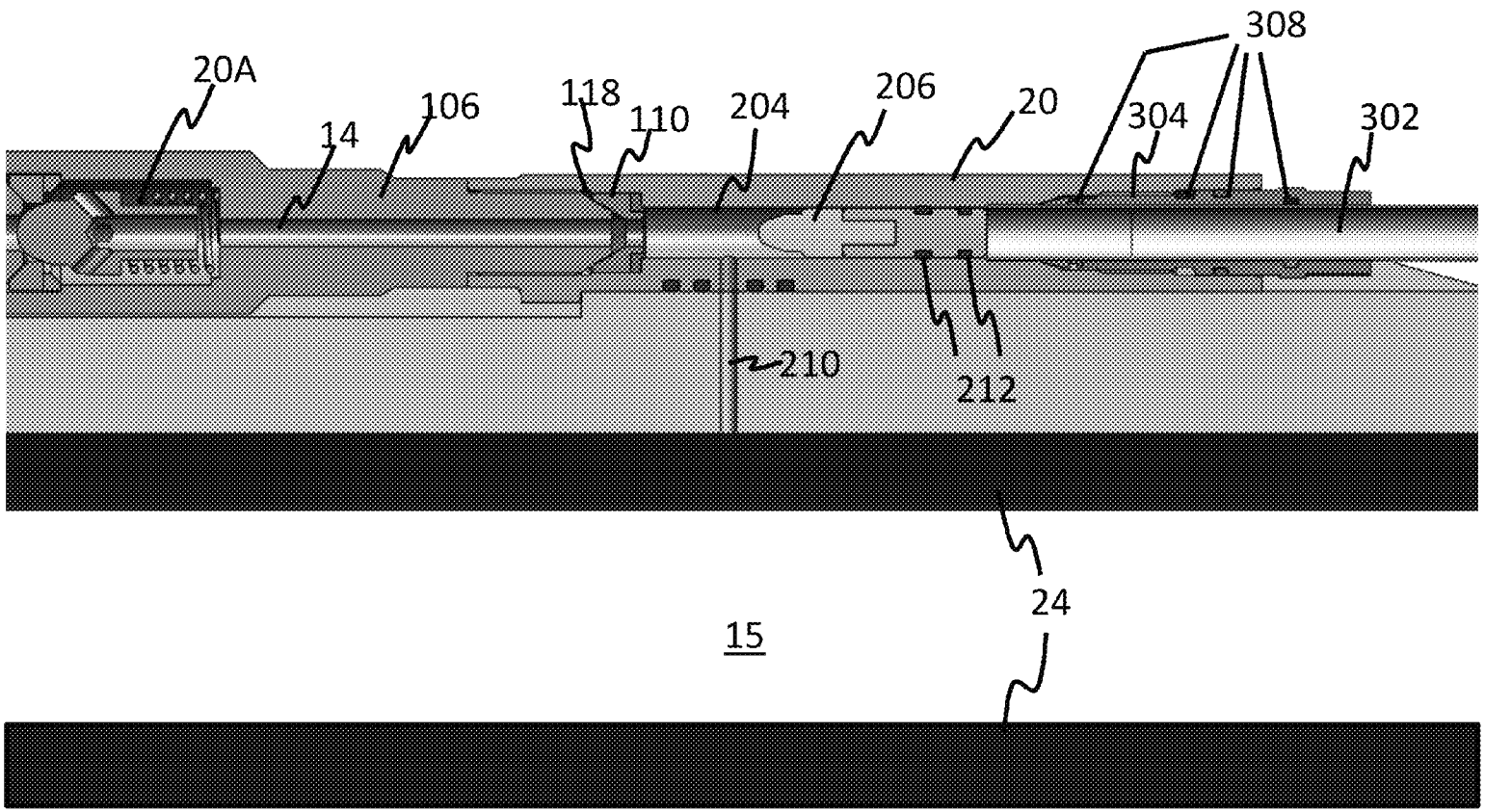
FIG. 7 is a depiction of a side view of the manifold version of the shut off valve.

The manifold version of the shut off valve functions in exactly the same manner as the shut off valve depicted in the FIGS. 1-5. FIG. 7 is a depiction of a side view of the manifold version of the shut off valve.

In the FIG. 7, it may be seen that the nipple 106 is extended in size from that depicted in the FIG. 3. The extended design of the nipple 106 permits the exclusion of the collet and the sleeve. The extended nipple 106 contacts the check pad 110 which is disposed against the compression ring 112. A seal 119 is disposed between the nipple 106 and the check pad 110. A valve seat 202 may or may not be used in the cylinder 204. The nipple 106 has through it the chemical flow line 14, which opens to the cylinder 204. As detailed above, the cylinder 204 has a piston shaft 208 that can move back and forth to open or block the path of the fluid that is used to dissolve or degrade debris in the mandrel channel 15. A port 210 serves as a fluid communication between the chemical flow line 14 and the mandrel channel 15.

Figure 8:
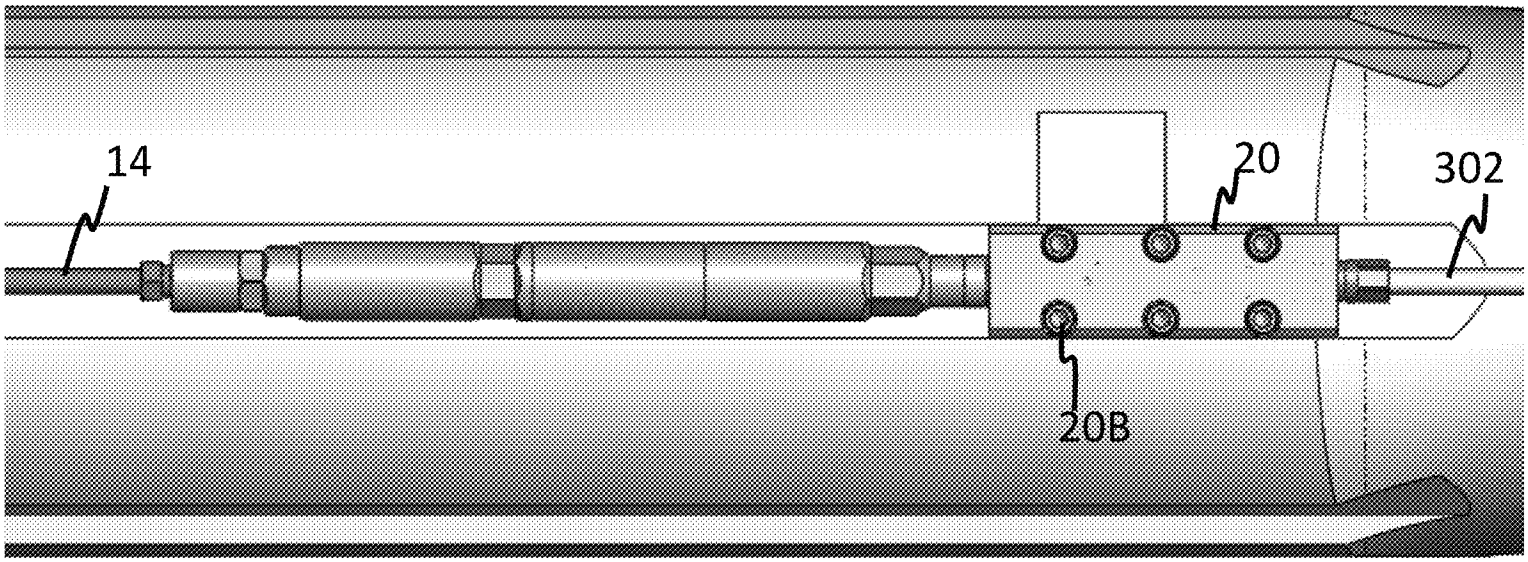
FIG. 8 is a top view of the manifold design shut off valve and shows the manifold disposed in the slot in the mandrel.

The piston shaft 208 is activated by the actuating assembly that comprises an actuator 302 disposed in a sleeve 304. The actuating assembly 300 along with the valve assembly 200 are disposed in the manifold 20. The manifold 20 encompasses the valve assembly 200 and a portion of the actuating assembly 300. As can be seen in the FIG. 7, the manifold 20 encompasses a portion of the nipple 106 and the valve assembly 200. The manifold 20 may comprise two halves—an upper half and a lower half, which can be reversibly connected with screws 20B (See FIG. 8) to form the manifold and to encompass the valve assembly 200 and the actuating assembly 300. FIG. 8 is a top view of the manifold design shut off valve and shows the manifold 20 disposed in the slot in the mandrel 24.

O-rings (e.g., 320) may be disposed on the outside of the manifold 20 to prevent leakage from the shut off device 22. Other O-rings (e.g., 212, 308) as described above are shown in the FIG. 7. These O-rings are optional and function to prevent leakage from the shut off device 22 as has also been detailed above. The design shown in the FIG. 7 contains one additional seal. A seal 119 is disposed between the nipple 106 and the check pad 110. This seal 119 prevents leakage from the point of contact between the nipple 106 and the check pad 110.

The design of the FIG. 7 functions in the same manner as described above. When the pressure in the chemical flow line 14 exceeds the pressure on the piston shaft 208 from the actuating assembly 300, the sealing object 206 is moved away from the valve seat to create a fluid pathway between the chemical flow line 14 and the mandrel channel 15. The chemical introduced into the mandrel flow line 14 is capable of dissolving or degrading debris and provide a passage for the flow of fluids normally associated with hydrocarbon recovery. When the debris are removed, the actuator pressure is increased to exceed the fluid pressure in the chemical flow line. This causes the sealing object 206 to contact the valve seat to cut off the fluid flow to the mandrel channel 15.

The designs disclosed herein are advantageous in that they can facilitate the removal of debris during hydrocarbon recovery operations. The shut off device 22 provides for a quick rehabilitation of the mandrel channel so that it can be used for recovery of hydrocarbons without any serious downtime in production.

While the invention has been described with reference to some embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A shut off system for a hydrocarbon recovery mandrel comprising:

an inline valve assembly comprising:

a nipple comprising a chemical flow line; the chemical flow line being operative to transfer fluids from outside the wellbore to a mandrel channel; where the mandrel channel is disposed in the mandrel; and a check pad in communication with the nipple via a sleeve to form a fluid leak proof contact and where the check pad contains a passage for the chemical flow line to contact the cylinder; where the sleeve is in direct contact with the nipple and in direct contact with the check pad to form a fluid leak proof contact and where the sleeve contains a passage for the chemical flow line to contact the cylinder;

a valve assembly comprising:

a cylinder and a piston shaft; where the cylinder contacts the chemical flow line;

where the piston shaft reciprocates in the cylinder in response to opposing applied pressures;

where the piston shaft contacts a sealing object that is operative to facilitate or to prevent fluid flow from the chemical flow line to the mandrel channel; where the cylinder comprises a port that provides fluid communication from the cylinder to the mandrel channel; and an actuating assembly; where the actuating assembly is operative to displace the piston shaft in the cylinder to prevent fluid communication between the chemical flow line and the mandrel channel.

2. The shut off system of claim 1, where the sleeve is disposed between the nipple and the check pad.

3. The shut off system of claim 1, further comprising a seal disposed between the sleeve and the nipple.

4. The shut off system of claim 1, where the inline valve assembly further comprises a compression ring; where the compression ring is disposed between the cylinder and check pad.

5. The shut off system of claim 4, where the compression ring comprises an elastomer or a soft metal.

6. The shut off system of claim 1, where the inline valve assembly comprises a nut; where the nut is operative to facilitate leak proof contact between a collet; the nipple, a sleeve and a check pad.

7. The shut off system of claim 1, where the cylinder comprises a cylinder head; and where the cylinder head comprises a valve seat that is contacted by the sealing object to terminate the flow of fluid from the chemical flow line to the mandrel channel.

8. The shut off system of claim 1, where the actuating assembly comprises an actuator; where the actuator is an electrical actuator; a pneumatic actuator, a hydraulic actuator; or a combination thereof.

9. The shut off system of claim 1, where the inline valve assembly, the valve assembly and the actuating assembly each contact test plugs that are used to test for leakages.

10. The shut off system of claim 1, where the inline valve assembly, the valve assembly and the actuating assembly each have O-rings disposed on their outer surfaces to prevent leakages.

11. The shut off system of claim 1, where the shut off system is disposed on an outer surface of a mandrel.

12. The shut off system of claim 11, where the shut off system is disposed in a housing in the mandrel; where the housing has a protective cover that protects the shut off system.

13. The shut off system of claim 1, where the shut off system is disposed in a manifold; where the manifold is disposed in a slot in the mandrel; and where the mandrel comprises two halves; each half having a channel to encompass the shut off system.

14. The shut off system of claim 13, where the manifold is fixedly attached to the mandrel by screws.

15. The shut off system of claim 1, further comprising a switch line that establishes fluid communication between the actuating assembly and the chemical flow line and where the switch line is used to change the direction of travel of the piston shaft.

16. A method comprising:

discharging a chemical fluid from outside a wellbore to a mandrel channel through a chemical flow line in a shut off system; where the shut off system comprises:

an inline valve assembly comprising:

a nipple comprising a chemical flow line; the chemical flow line being operative to transfer fluids from outside the wellbore to a mandrel channel; where the mandrel channel is disposed in the mandrel; and a check pad in communication with the nipple via a sleeve to form a fluid leak proof contact and where the check pad contains a passage for the chemical flow line to contact the cylinder; where the sleeve is in direct contact with the nipple to form a fluid leak proof contact and where the sleeve contains a passage for the chemical flow line to contact the cylinder;

a valve assembly comprising:

a cylinder and a piston shaft; where the cylinder contacts the chemical flow line;

where the piston shaft reciprocates in the cylinder in response to opposing applied pressures;

where the piston shaft contacts a sealing object that is operative to facilitate or to prevent fluid flow from the chemical flow line to the mandrel channel; where the cylinder comprises a port that provides fluid communication from the cylinder to the mandrel channel; and an actuating assembly; where the actuating assembly is operative to displace the piston shaft in the cylinder;

increasing the pressure of the fluid in the chemical flow line to exceed the pressure exerted by the actuating system on the piston shaft;

displacing the sealing object from the chemical flow line; and facilitating the flow of fluid from the chemical flow line to the mandrel channel.

17. The method of claim 16, further comprising actuating the piston to contact the chemical flow line; and preventing the flow of fluid from the chemical flow line to the mandrel channel.

18. The method of claim 17, where a direction of displacement of the sealing object is effected by transporting fluid via either the chemical flow line or a switch line that is in fluid communication with the actuating assembly.

* * * * *